US006328535B1

(12) United States Patent
Brighton et al.

(10) Patent No.: US 6,328,535 B1
(45) Date of Patent: Dec. 11, 2001

(54) FLOW CONTROL VALVE CAPABLE OF ADJUSTING FLUID FLOW CHARACTERISTICS IN ACCORDANCE WITH A POSITION OF A VALVE ELEMENT IN A BORE

(75) Inventors: Derek Brighton, Rochester; Alec Thornelow, Chatham, both of (GB)

(73) Assignee: Hobourn Automative Limited, Kent (GB)

( * ) Notice: Subject to any disclaimer, the term of this patent is extended or adjusted under 35 U.S.C. 154(b) by 0 days.

(21) Appl. No.: 09/341,179

(22) PCT Filed: Dec. 31, 1997

(86) PCT No.: PCT/GB97/03559

§ 371 Date: Jul. 6, 1999

§ 102(e) Date: Jul. 6, 1999

(87) PCT Pub. No.: WO98/29663

PCT Pub. Date: Jul. 9, 1998

(30) Foreign Application Priority Data

Jan. 3, 1997 (GB) ..... 9700068

(51) Int. Cl.[7] ..... F04B 49/00

(52) U.S. Cl. ..... 417/220; 137/115.04; 137/115.06; 137/115.15

(58) Field of Search ..... 137/115.1, 493.9, 137/115.06, 115.09; 417/220

(56) References Cited

U.S. PATENT DOCUMENTS

| | | | | |
|---|---|---|---|---|
| 4,522,565 | * | 6/1985 | Stockton | 417/220 |
| 4,897,996 | | 2/1990 | Hagin et al. . | |
| 5,409,032 | | 4/1995 | Berfield . | |
| 5,460,198 | * | 10/1995 | Kortge | 137/116.3 |
| 5,513,672 | * | 5/1996 | Nguyen et al. | 137/117 |
| 5,580,817 | * | 12/1996 | Kortge | 137/115.15 |
| 5,597,008 | * | 1/1997 | Overdiek et al. | 137/15 |
| 5,685,332 | * | 11/1997 | Overdiek et al. | 137/115.04 |

FOREIGN PATENT DOCUMENTS

| | | |
|---|---|---|
| 033698 | 8/1981 | (EP) . |
| 0118049 | 9/1984 | (EP) . |
| 0428374 | 5/1991 | (EP) . |
| 0648931 | 4/1995 | (EP) . |
| 2044886 | 10/1980 | (GB) . |
| 2202611 | 9/1988 | (GB) . |

* cited by examiner

*Primary Examiner*—Cheryl J. Tyler
(74) *Attorney, Agent, or Firm*—Wenderoth, Lind & Ponack, L.L.P.

(57) ABSTRACT

A flow control valve has body (20) containing a "bucket" shaped valve element (1) that moves in a bore (2). The valve element (1) has a discharge orifice (8) through which a needle valve (9) projects. Movement of the valve element (1) within the bore (2) adjusts the annular clearance between the orifice (8) and the needle (9) thereby varying the pressure drop across the valve element (1) and the rate of the main flow through the valve. The inlet (4*a*) to the body (20) is located upstream of the valve element. With this arrangement, the spill flow rate is adjusted by movement of the valve element (1) within the bore (2). However, in all cases the main flow of fluid passes through the orifice (8) of the valve element (1) through the bore (2) to the outlet (10), thereby avoiding the formation of stagnant "pools" of fluid within the bore (2) of the flow control valve.

19 Claims, 3 Drawing Sheets

FLOW CONTROL VALVE CAPABLE OF ADJUSTING FLUID FLOW CHARACTERISTICS IN ACCORDANCE WITH A POSITION OF A VALVE ELEMENT IN A BORE

BACKGROUND OF THE INVENTION

The present invention relates to a flow control valve, and in particular to a flow control valve having improved flow control characteristics resulting in improved output flow rates and pressures. The valve is particularly suited to pumps which pump fluids, predominantly containing liquids.

In a known pump assembly, the discharge from the pumping element flows to a valve arrangement having a valve element nominally floating in a bore. The valve arrangement includes a cavity into which the discharge from the pumping element flows. The cavity includes a discharge orifice through which fluid flows from the cavity with a pressure drop being established across the discharge orifice. The cavity has a further separate opening into the bore in which the valve element is "floating". On the downstream side of the discharge orifice, a passage runs to the side of the bore, distant from the cavity, relative to the valve element. Thus, the valve element is balanced with two pressures, the pumping pressure (of the fluid in the cavity) acting on one end and the discharge pressure (determined by the discharge orifice) applied to the other end. A biasing member in the form of a spring is also provided to bias the valve element towards the cavity, whilst the pressure difference across the valve element acts to bias the valve element away from the cavity. In this way the valve arrangement is located in a bore which communicates across the discharge orifice of the cavity which in turn means that the valve element is separate from the discharge orifice.

In this arrangement, if the pumping pressure exceeds the discharge pressure by more than a predetermined amount, the valve element becomes sufficiently displaced from its position of zero displacement (i.e. its position when there is no pressure difference across the valve element) to open a channel to a spill port which directs fluid from the cavity back to the inlet of the pump. The difficulty with this arrangement is that there is insufficient control of the discharge flow rate, from the discharge orifice, with respect to pump speed and pressure. In fact, with such an arrangement, the discharge flow rate tends to increase with both pump speed and pressure.

The disadvantage described above with the conventional valve arrangement can be mitigated to an extent by forming a small recess in the front of the valve element and by suitable shaping of the spill port. Additionally, the valve arrangement may be improved by providing a "needle" (a rod having a profiled shape) on the end of the valve element which moves in the discharge orifice formed in a discharge plug aligned with the valve element, such that the annular area between the needle and the circumference of the discharge orifice varies with the movement of the valve element in the bore. The problems with this arrangement are that the needle position is fixed relative to the position of the valve element, the needle is expensive to manufacture and the region within the bore where the discharge pressure acts has an almost stagnant pool of fluid, where problems of contamination can develop. The valve element must also be further increased in complexity because of the need to incorporate within it a pressure relief valve, which opens at a high pressure setting (e.g. approximately 50–70 bars) to relieve pressure back to the pump inlet in the event of overloading the output.

SUMMARY OF THE INVENTION

The present invention seeks to provide a flow control valve which addresses the above identified disadvantages and provides an improvement over the prior art referred to.

According to the present invention there is provided a flow control valve comprising a body, a bore having first and second axial ends, the bore being formed within the body of the valve; a valve element movably located within the bore; an inlet in communication with the first axial end of the bore; an outlet in communication with the second axial end of the bore; adjustment means for adjusting at least one characteristic of the flow of fluid through the flow control valve in accordance with the position of the valve element within the bore; and a discharge orifice formed in the valve element for establishing a pressure differential across the valve element between the first and second axial ends of the bore.

With the present invention, therefore, the valve element, in combination with the discharge orifice in the valve element, provides the primary route through the valve to the outlet for discharging fluid, i.e. the main flow of fluid through the valve passes from the inlet into the valve element via the discharge orifice and out of the valve element via its open end to the outlet. This avoids the formation of stagnant "pools" of fluid either upstream or downstream of the valve element, as the majority of the fluid generally flows along the main axis of the flow control valve and is not diverted into a side channel.

The adjustment means preferably includes a spill port having an opening into the first axial end of the bore, the valve element being slidable axially within the bore between a first position, in which the opening of the spill port is blocked by the valve element, and a second position in which the opening to the spill port from the first axial end of the bore is not blocked by the valve element. In this way, a substantially constant pressure drop across the discharge orifice may be maintained.

Alternatively, or additionally, the adjustment means may include a needle which is positioned so as to project through the discharge orifice such that movement of the valve element within the bore causes relative movement between the discharge orifice and the needle which relative movement alters the clearance between the needle and discharge orifice. In this context, the needle functions as a variable closure member in relation to which the valve element and hence the discharge orifice move such that the relative movement between the valve element and the variable closure member alters the volume of fluid which flows per second through the discharge orifice. It is generally envisaged that the variable closure member will take the form of a shaped rod the external cross-sectional area of which varies along its length and which is mounted so that the free end of the rod projects through the discharge orifice such that relative axial movement between the valve element and the rod will cause the annular clearance between the rod and the discharge orifice to vary in size thus varying the volume of fluid which can flow through the clearance per second.

By mounting the needle so that the valve element (and thus, in the present invention, the discharge orifice) moves relative to it, there is much greater flexibility in the scope for design variations of the needle as it need not be attached to the valve element. For example, the needle may be rigidly fitted concentric or eccentric with the discharge orifice, it may be permitted to fall to one side of the discharge orifice to improve the consistency of flow restriction, or it may be mounted with flexibility axially and/or radially (with a device such as a spring, a pad or another valve) to increase the variables available for control of the rate of flow of fluid through the discharge orifice. There are also other advantages to the arrangement of the present invention such as the avoidance of the near stagnant area of fluid at the second axial end of the bore, and also, the needle is much cheaper and easier to manufacture. As the output or discharge of the flow control valve is straight through the discharge orifice in the valve element, no communication channel needs to be made to the second axial end of the bore from the downstream side of the discharge orifice, as is the case in the prior art, and so fluid and consequent pressure loss may be reduced.

By providing a small hole bored through the needle a safety pressure relief valve may be positioned in the closing plug or at any convenient location remote from the bore which senses the fluid pressure in the second axial end of the bore or, in other words, the discharge or output pressure of the flow control valve. Operation of this safety relief valve both increases the flow of fluid through the discharge orifice and causes the valve element to move towards its second position thus opening the spill port and generally preventing any excess pressure build-up without the requirement of a complicated and expensive pressure release valve in the valve element itself. The dimensions of the hole bored through the needle can be selected to provide a pressure drop from one end of the hole to the other which may be useful for shaping the control characteristics of the safety pressure relief valve during spilling of fluid from the first axial end of the bore into the spill port. The safety pressure relief valve may be fitted anywhere in the valve body provided it is in communication with the downstream side of the discharge orifice. Preferably the safety pressure relief valve is arranged to spill fluid through the safety pressure relief valve directly into the inlet of the pump from the pump discharge of which fluid to the inlet of the flow control valve is driven. Thus, the safety pressure relief valve may be fitted in the valve bore to communicate directly with the second axial end of the bore (the needle hole is then not required), or somewhere else along the output of the flow control valve without there being a significant pressure drop from the output flow to the safety pressure relief valve. However, with such an arrangement the additional control option provided by the pressure drop is lost.

BRIEF DESCRIPTION OF THE DRAWINGS

In order that the present invention may be better understood an embodiment thereof will now be described by way of example only with reference to the accompanying drawings, in which.

DETAILED DESCRIPTION OF THE PREFERRED EMBODIMENTS

Figure 1:
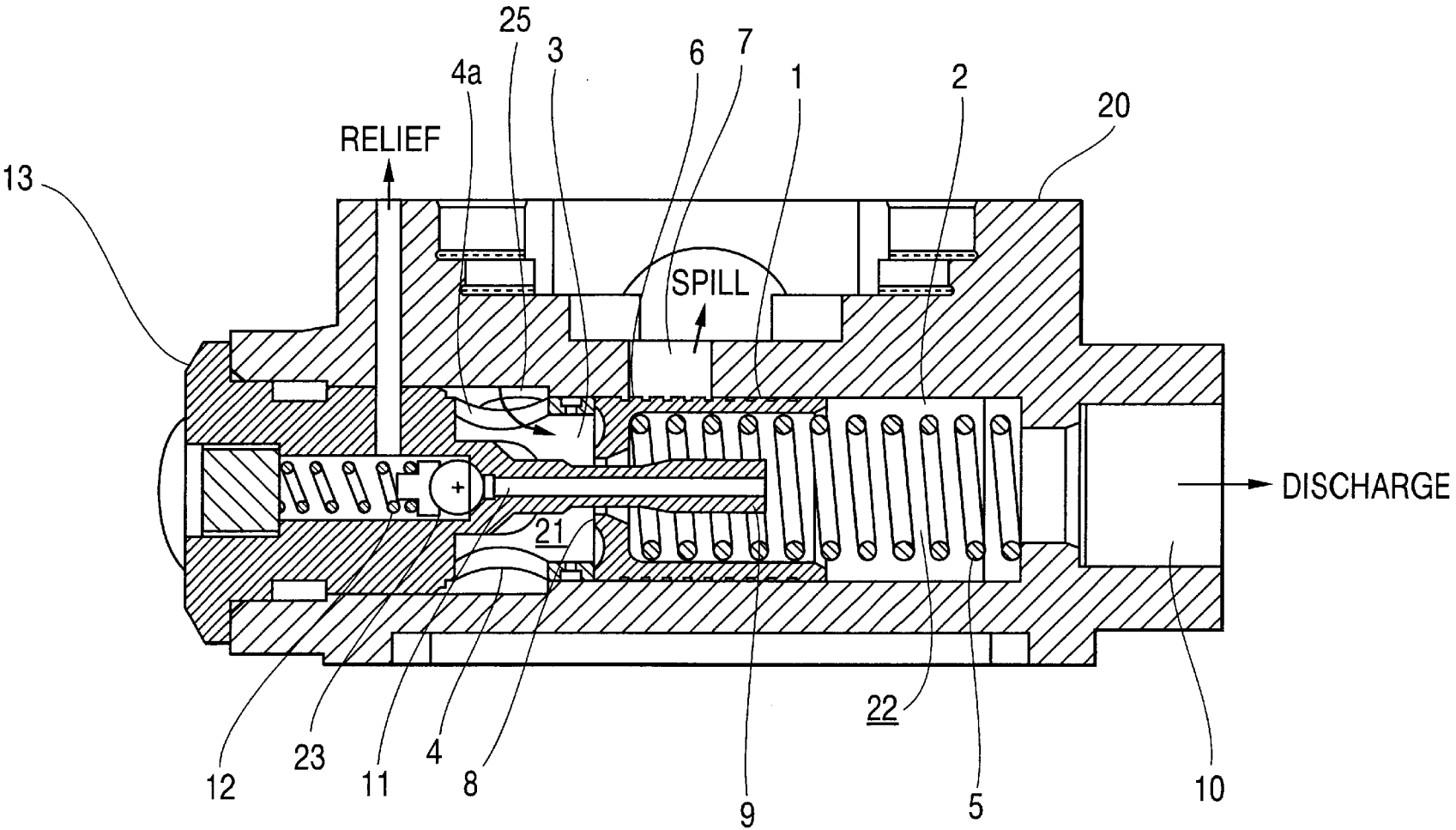
FIG. 1, is a cross-sectional view through a flow control valve in accordance with the present invention.
Figure 2:
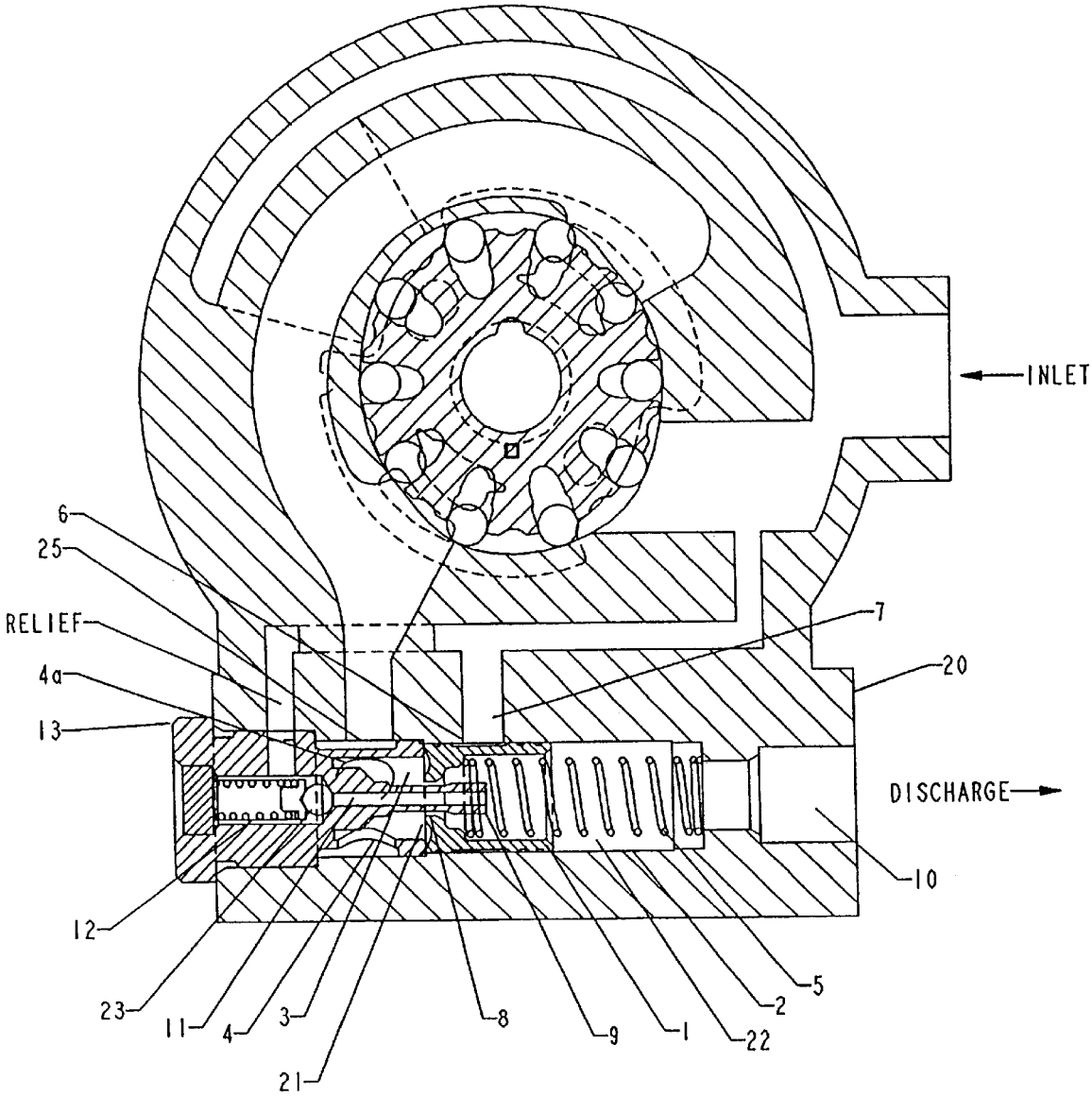
FIG. 2 shows the valve as is suited for use as a flow control valve on the outlet of a fluid pump. In particular, the valve may be used with the type of pump having a carrier mounted on a shaft for rotation therewith, a plurality of pumping elements mounted radially extendibly within or on the carrier, a cam ring whose internal surface is followed by the pumping elements as the shaft, carrier and pumping elements rotate with respect to the cam ring, and which is not co-axial with the carrier, a pump inlet and a pump outlet, and wherein the flow control valve is connected to the pump outlet.

A valve body 20 contains a "bucket" shaped valve element 1 which moves in a close fitting bore 2. Fluid is pumped into a radial passage 25 and into a cavity 3 in a first axial end of the bore 2, through holes 4*a* in a spacer 4, which holes 4*a* thus form an inlet to the cavity 3 of the flow control valve. The pumped, pressurized fluid may move the valve element 1 against the force of a precompressed spring 5 until the fluid in the cavity 3 starts to spill through entrance 6 into a return or spill port 7. A fixed needle 9 is mounted in the body 20 of the valve and projects through a cavity discharge orifice 8 formed within the valve element 1. Movement of the valve element 1 in the bore 2 causes the annular clearance between the cavity discharge orifice 8 and the fixed needle 9, which has a tapered profile, to change in cross-sectional area, such that the pressure drop across the valve element 1 from a first axial end 21 of the bore 2 to a second axial end 22 of the bore 2 varies. The movement of the valve element 1 also modifies the spill flow rate through entrance 6 into return port 7. By suitably selecting the profile of the needle 9 and the shape of the entrance 6 to the return port 7 the desired output flow rate via cavity 10, which thus forms an outlet of the valve, may be achieved.

Also shown in FIG. 1 is a capillary hole 11 bored through the needle 9 which feeds pressure to a cavity 12 by way of a safety pressure relief valve 23 mounted in a plug 13, such that relief flow through the capillary hole 11 causes the flow rate through the discharge valve 8 to increase. At the same time, the reduction in pressure in the second axial end 22 of the bore 2 increases the pressure drop between the first axial end 21 of the bore 2 and the second axial end 22 of the bore 2 which in turn causes the valve element 1 to move away from the cavity 3 thus opening the valve edge of the entrance 6 to the return port 7 to a larger extent, which in turn allows the bulk of the excess fluid from the cavity 3 to flow out of the flow control valve and, via a suitable passage (not shown), to the pump return.

The plug 13 secures the flow control valve assembly and spring 5 within the bore 2. The most important elements of the flow control valve whose dimensions may be altered in order to control the flow characteristics of the valve are the relative sizes of the discharge orifice 8, the capillary hole 11, the opening 6 to the return port 7 and the profile of the needle 9; the viscosity of the fluid being pumped through the valve will also affect the flow characteristics of the valve.

Figure 3:
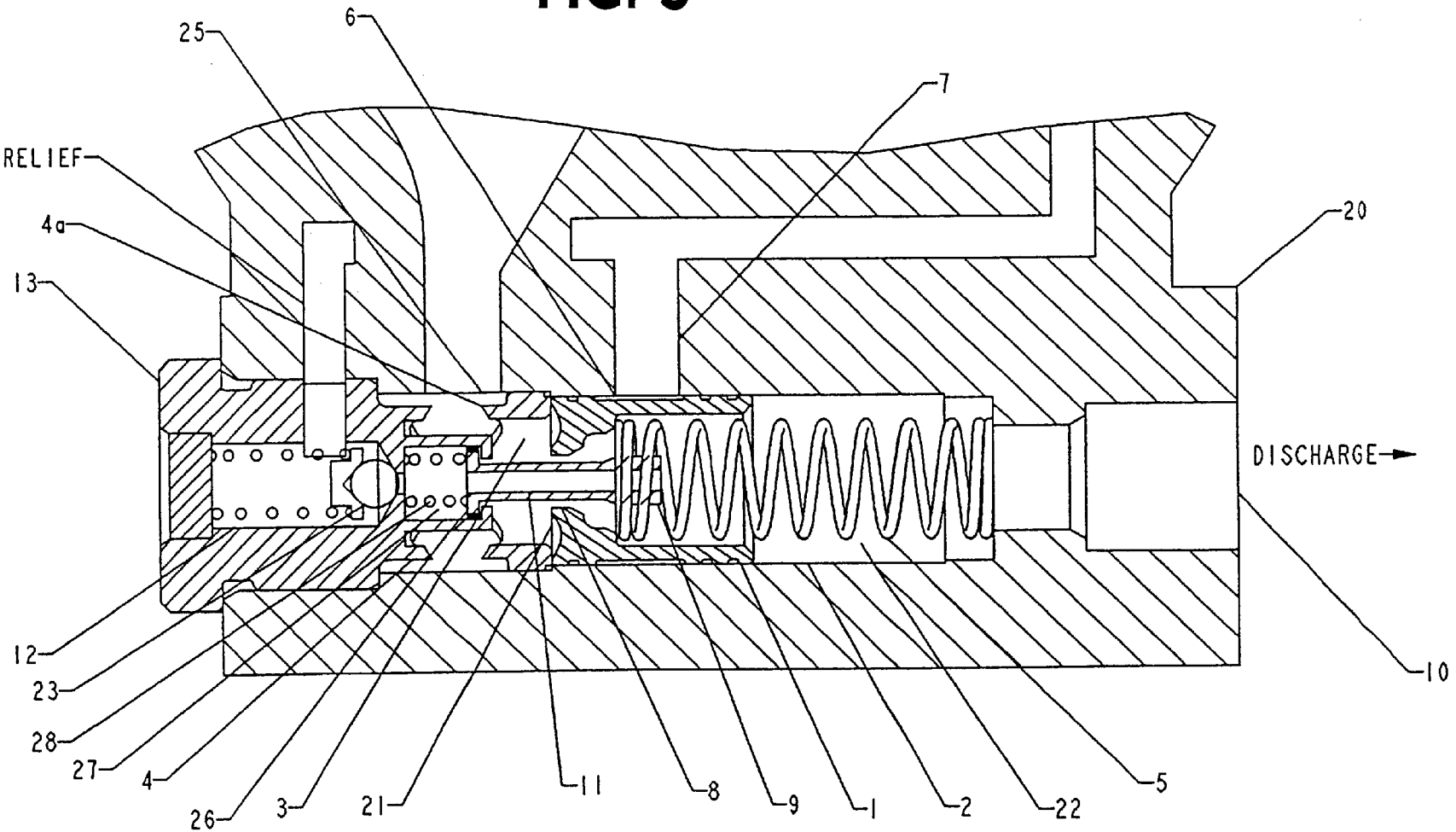
FIG. 3 illustrates a valve similar to FIG. 1 but showing a needle mounted on a flexible platform.

As shown in FIG. 3, the needle 9 may be mounted on a flexible platform 26 which is attached to the body of the valve. The flexible platform can be used to move the needle axially, radially or both against the resistance of spring 28 by the pressure difference between the cavity 3 and cavity 27, so that the valve element and needle 9 may be caused to move simultaneously or independently, depending on the spring characteristics. This acts as a further control of the fluid rate through the valve. Also, the needle need not be concentric with either the bore or the discharge orifice. An eccentric position may afford improved consistency of flow restriction.

It will be apparent to a person skilled in the art that alternative arrangements of the valve concept may be employed without departing from the scope of the present invention as set out in the claims. In particular, the shape of the needle may be adjusted as required. The valve element 1 needs only to "seal" (reduce leakage to acceptable values compared with that flowing through the annular clearance between the discharge orifice 8 and the needle 9) so it may take any shape compatible with the bore shape provided it is free to move axially. The output cavity 10 may be connected to an outlet fitting which may incorporate a second cap to facilitate boring and spring mounting. The choice of materials used essentially depends on the strength, machining cost and fluid compatibility of the various elements of the flow control valve, but irons, steels or aluminium alloys are preferred. Mechanical force devices are most conveniently fitted as coil springs, but are not exclusively so. The valve discharge orifice shape is normally a constant diameter bore, but could be some other variable shape. The valve element may be moved with electrical or mechanical devices controlled by the pressures in addition to or instead of using a mechanical force device such as a spring. Finally, the term "fluid" is used in a generic sense to include any liquid, possibly containing free gas, but in practice a lubricating fluid, for low friction wear, will be preferred. Details of the safety pressure relief valve and its location are immaterial except as how they require features in the flow control valve to operate.

What is claimed is:

1. A flow control valve comprising a body; a bore having first and second axial ends, the bore being formed within the body of the valve; a valve element movably located within the bore; an inlet in communication with the first axial end of the bore; an outlet in communication with the second axial end of the bore; adjustment means for adjusting at least one characteristic of the flow of fluid through the flow control valve in accordance with the position of the valve element within the bore; and a discharge orifice formed in the valve element for establishing a pressure differential across the valve element between the first and second axial ends of the bore; wherein the adjustment means includes a spill port having an opening into the first axial end of the bore and wherein the valve element is slidable axially within the bore, between the inlet and the outlet, between a first position, in which the opening of the spill port is blocked by the valve element, and a second position in which the opening to the spill port from the first axial end of the bore is not blocked by the valve element, the valve further comprising biasing means for biasing the valve element towards said first position, said biasing means being disposed in the fluid flow path between the discharge orifice and the outlet so as to reduce stagnant regions in the valve.

2. A flow control valve as claimed in claim 1, wherein the adjustment means further includes a variable closure member, the valve element being arranged to move relative to the variable closure member whereby the open area of the discharge orifice is altered.

3. A flow control valve as claimed in claim 2, wherein the variable closure member is in the form of a needle which is positioned so as to project through the discharge orifice, the arrangement of the needle with respect to the discharge orifice being such that movement of the valve element in the bore causes relative movement between the discharge orifice and the needle so as to alter the clearance between the needle and the discharge orifice.

4. A flow control valve as claimed in claim 3, wherein said needle has a hole bored therethrough whereby the pressure within the second axial end of the bore is communicated to a safety pressure relief valve for preventing dangerously high pressures from developing in the valve.

5. A flow control valve as claimed in claim 3, wherein the external cross-sectional area of the needle varies along its length.

6. A flow control valve as claimed in claim 3, wherein the needle is mounted on a flexible platform which is attached to the body of the valve.

7. A flow control valve as claimed in claim 6, wherein the flexible platform comprises a spring, a soft pad, a pressure controlled device or a similar device which permits the needle to move axially, radially or both as required to control the rate of flow of fluid through the discharge orifice.

8. A flow control valve as claimed in claim 1 further comprising a safety pressure relief valve communicating with the second axial end of the bore whereby, when the safety pressure relief valve is opened, the flow of fluid through the discharge orifice is increased causing the flow control valve to open further and act a s a secondary relief valve by increasing communication between the inlet and the spill port.

9. A pump assembly including a flow control valve as claimed in any one of the preceding claims, said pump assembly comprising a carrier mounted on a shaft for rotation therewith, a plurality of pumping elements mounted radially extendibly within or on the carrier, a cam ring which internal surface is followed by the pumping elements as the shaft, carrier and pumping elements rotate with respect to the cam ring, and which is eccentric with regard to the axis of the carrier, a pump inlet and a pump outlet, and wherein the flow control valve is connected to the pump outlet.

10. A flow control valve as claimed in claim 2, further comprising a safety pressure relief valve communicating with the second axial end of the bore whereby, when the safety pressure relief valve is opened, the flow of fluid through the discharge orifice is increased causing the flow control valve to open further and act as a secondary relief valve by increasing communication between the inlet and the spill port.

11. A flow control valve as claimed in claim 3, further comprising a safety pressure relief valve communicating with the second axial end of the bore whereby, when the safety pressure relief valve is opened, the flow of fluid through the discharge orifice is increased causing the flow control valve to open further and act as a secondary relief valve by increasing communication between the inlet and the spill port.

12. A flow control valve as claimed in claim 5, wherein the needle is mounted on a flexible platform which is attached to the body of the valve.

13. A flow control valve as claimed in claim 5, wherein said needle has a hole bored therethrough whereby the pressure within the second axial end of the bore is communicated to a safety pressure relief valve for preventing dangerously high pressures from developing in the valve.

14. A flow control valve as claimed in claim 5, further comprising a safety pressure relief valve communicating with the second axial end of the bore whereby, when the safety pressure relief valve is opened, the flow of fluid through the discharge orifice is increased causing the flow control valve to open further and act as a secondary relief valve by increasing communication between the inlet and the spill port.

15. A flow control valve as claimed in claim 6, wherein said needle has a hole bored therethrough whereby the pressure within the second axial end of the bore is communicated to a safety pressure relief valve for preventing dangerously high pressures from developing in the valve.

16. A flow control valve as claimed in claim 6, further comprising a safety pressure relief valve communicating with the second axial and of the bore whereby, when the safety pressure relief valve is opened, the flow of fluid through the discharge orifice is increased causing the flow control valve to open further and act as a secondary relief valve by increasing communication between the inlet and the spill port.

17. A flow control valve as claimed in claim 7, wherein said needle has a hole bored therethrough whereby the pressure within the second axial end of the bore is communicated to a safety pressure relief valve for preventing dangerously high pressures from developing in the valve.

18. A flow control valve as claimed in claim 7, further comprising a safety pressure relief valve communicating with the second axial end of the bore whereby, when the safety pressure relief valve is opened, the flow of fluid through the discharge orifice is increased causing the flow control valve to open further and act as a secondary relief valve by increasing communication between the inlet and the spill port.

19. A flow control valve comprising a body; a bore having first and second axial ends, the bore being formed within the body of the valve; a valve element movably located within the bore; an inlet in communication with the first axial end of the bore; an outlet in communication with the second axial end of the bore; adjustment means for adjusting at least one characteristic of the flow of fluid through the flow control valve in accordance with the position of the valve element within the bore; and a discharge orifice formed in the valve element for establishing a pressure differential across the valve element between the first and second axial ends of the bore; wherein the majority of the fluid flows through the discharge orifice to the outlet substantially along the primary axis of the bore; the valve further comprising biasing means for biasing the valve element, said biasing means being disposed between the discharge orifice and the outlet in the fluid flow path so as to reduce stagnant regions in the valve.

* * * * *